US006923330B1

(12) United States Patent
Nagel

(10) Patent No.: US 6,923,330 B1
(45) Date of Patent: Aug. 2, 2005

(54) PULL STRIP ACTUATED PUSHER FOR MERCHANDISE DISPLAYS

(75) Inventor: Thomas O. Nagel, Blairstown, NJ (US)

(73) Assignee: Trion Industries, Inc., Wilkes-Barre, PA (US)

( * ) Notice: Subject to any disclaimer, the term of this patent is extended or adjusted under 35 U.S.C. 154(b) by 64 days.

(21) Appl. No.: 10/608,455

(22) Filed: Jun. 27, 2003

(51) Int. Cl.[7] ..... A47F 7/00
(52) U.S. Cl. ..... 211/59.3
(58) Field of Search ..... 211/59.3, 49.1, 211/59.2, 94.01, 162

(56) References Cited

U.S. PATENT DOCUMENTS

| | | | | |
|---|---|---|---|---|
| 1,702,987 | A | 2/1929 | Wilson | |
| 1,910,046 | A | 5/1933 | Pascoe | |
| 2,079,754 | A | 5/1937 | Waxgiser | |
| 2,098,844 | A | 11/1937 | Waxgiser | |
| 2,980,259 | A | 4/1961 | Fowlds | |
| 3,161,295 | A | 12/1964 | Chesley | |
| 3,308,961 | A * | 3/1967 | Chesley | 211/59.3 |
| 4,907,707 | A * | 3/1990 | Crum | 211/59.3 |
| 5,012,936 | A * | 5/1991 | Crum | 211/59.3 |
| 5,413,229 | A | 5/1995 | Zuberbuhler et al. | |
| 5,469,976 | A | 11/1995 | Burchell | |
| 6,155,438 | A | 12/2000 | Close | |
| 6,227,386 | B1 | 5/2001 | Close | |
| 6,464,089 | B1 * | 10/2002 | Rankin, VI | 211/59.3 |
| 6,527,127 | B2 * | 3/2003 | Dumontet | 211/59.3 |
| 6,666,533 | B1 * | 12/2003 | Stavros | 312/348.3 |

* cited by examiner

*Primary Examiner*—Hugh B. Thompson, II
*Assistant Examiner*—Sarah Purol
(74) *Attorney, Agent, or Firm*—Schweitzer Cornman Gross & Bondell LLP

(57) ABSTRACT

A pull strip actuated pusher assembly for up-front merchandise display, wherein a frictionally restrained pusher sled is actuated by a manually operated pull strip element slideably guided in an elongated base member. The pull strip is confined in a longitudinal groove in the base member, and restricted against vertical displacement relative to the base member by confining elements, such as overlying tabs, slideably engaging the pull strip in a limited area adjacent a forward end extremity of the base member. In areas behind such confining elements, the pull strip is relatively vertically unrestricted, except for the presence of the pusher sled, which at all times overlies portions of the pull strip. The pusher sled which is movable on the base independently of the pull strip, is assembled onto the base member after installation of the pull strip by a snap-on assembly procedure, which results in the pusher sled being locked together with base member. The pull strip has an abutment tab projecting upward from its back portion, engageable with the pusher sled, such that when the pull strip is drawn forwardly, the pusher sled is engaged and drawn forward with it to bring any merchandise on the display rack into an up-front position. The pull strip can then be returned to a retracted position, either leaving the sled in its adjusted position or returning it to the back of its base member. Where desired, a return spring may be attached to the pull strip member for automatic retraction of the pull strip. The item can be manufactured on a highly economical basis, suitable for high volume production and distribution for mass merchandising outlets.

12 Claims, 5 Drawing Sheets

PULL STRIP ACTUATED PUSHER FOR MERCHANDISE DISPLAYS

BACKGROUND OF THE INVENTION

Many merchandise displays make use of pusher elements that are positioned behind a row of product items, for the purpose of maintaining the products in an up-front position on the display shelving. This provides a neater looking display, as well as making the merchandise more conveniently accessible to the prospective customer.

Quite commonly, pusher elements are in the form of pusher sleds, guided for front to back movement on a suitable base and provided with coiled springs for constantly urging the pusher sleds in a forward direction. Such spring-driven pusher sleds can work satisfactorily when the spring is properly sized for the particular merchandise to be displayed, and the particular display is always stocked with the same merchandise or merchandise of very similar size and weight. However, if different merchandise is displayed, of a materially different weight, the spring-actuated operation of the pusher sled may be less than optimum, being unnecessarily powerful for lighter merchandise or inadequate for heavier merchandise.

Where the nature of the merchandise to be displayed can be expected to be variable, some merchandisers avoid the use of springs and instead utilize a manually operated pull strip for positioning the pusher sled. For these manually operated displays, a store clerk checks the displays periodically and, when appropriate, pulls outward on a pull strip to advance the pusher sled toward the front to reposition the merchandise. The pull strip is then returned to a normal, retracted position, where it remains until next operated by a store clerk.

SUMMARY OF THE INVENTION

The present invention is directed to a novel and improved pull strip actuated pusher assembly of the type described above which is particularly advantageous in that its desired functions are achieved by means of a design which is highly economical to manufacture and install, and is thus attractive for use by mass merchandisers. As will be understood, mass merchandisers utilize product display apparatus in huge quantities, and pricing is a highly significant aspect of product selection in terms of display equipment. The pusher sled arrangement according to the invention is capable of manufacture and assembly on a highly economical basis without comprising any of its functional features.

Pursuant to the invention, a pull strip actuated pusher arrangement is provided in which a pusher sled is mounted for guided movement on an elongated base member. A pull strip element is supported and guided by the base member and has a projection at its back end which is engageable with a rearwardly facing surface of the pusher sled enabling the pusher sled to be drawn forwardly by actuation of the pull strip. To advantage, the pull strip is vertically confined on the base member only in a limited area adjacent the front end of the base member. This greatly simplifies the molding of the base member, reducing its cost of manufacture. Portions of the pull strip behind the limited vertical confinement means are vertically unconfined other than by the presence of the overlying pusher sled, which may be at various positions along the pull strip. Initial assembly of the pull strip to the base member involves simply sliding the pull strip into a groove in the base member, underneath tabs provided adjacent the front end of the base member for vertical confinement. Pursuant to the invention, the pusher sled is thereafter installed over the pull strip, by a snap-on assembly procedure such that the three part assembly, the base member, the pusher sled and the pull strip are all locked in assembled relation.

In a preferred embodiment of the invention, one or both of the base member or pusher sled is provided with angled edge surfaces enabling the pusher sled to be assembled with the base member by applying downward force for a snap-on engagement. Once engaged, the parts are permanently locked together.

In the device of the invention, means are provided to define a positive limit stop for forward movement of the pusher sled. This forward limit position is so related to the positioning of the vertical confinement of the pull strip that, when the pull strip and the pusher sled are in their forward-most positions, the pull strip remains engaged by its vertical confinement. Accordingly, when returning the pull strip to a fully retracted position from any forward position, there is never a problem of having to realign the pull strip with its confinement at any position of the pull strip, in order to return it to a fully retracted position. Moreover, the pull strip is automatically prevented from being pulled entirely out of its working position in the base member. Advantageously, the pusher member is similarly provided with a rearward limit stop, preferably by providing a rearward limit stop for the pull strip, which in turn would limit the rearward motion of the pusher sled.

In an alternative embodiment of the invention, a return spring is advantageously attached to the pull strip, such that the pull strip is always automatically returned to its fully retracted position and can never be left partially projecting by a careless store person.

In another alternative embodiment, the pull strip can be provided with a second abutment tab, spaced forwardly of the first, and positioned such that, when the pusher member is snapped over the base member, it is positioned between the two abutment tabs. This enables the pusher sled to be returned to a retracted position along with the pull strip after advancing the merchandise. For certain types of packages, which are reliably self-standing, it is not necessary to support the packages with the pusher sled after they have been moved forwardly, and it may be preferred to retract the sled by means of the pull strip element.

For a more complete understanding of the above and other features and advantages of the invention, reference should be made to the following detailed description of a preferred embodiment of the invention, and to the accompanying drawings.

DESCRIPTION OF PREFERRED EMBODIMENT

Figure 1:
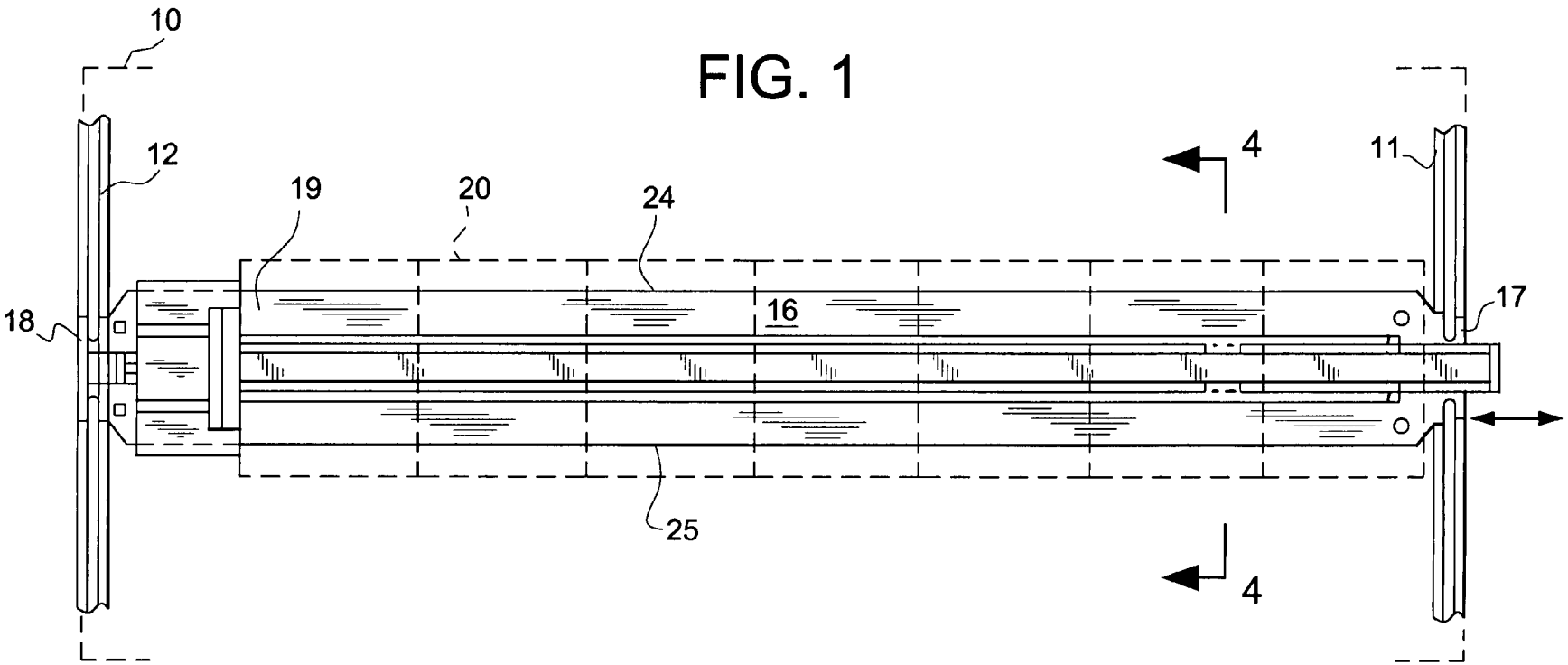
FIG. 1 is a top plan view of a pull strip actuated pusher assembly according to the invention.
Figure 2:
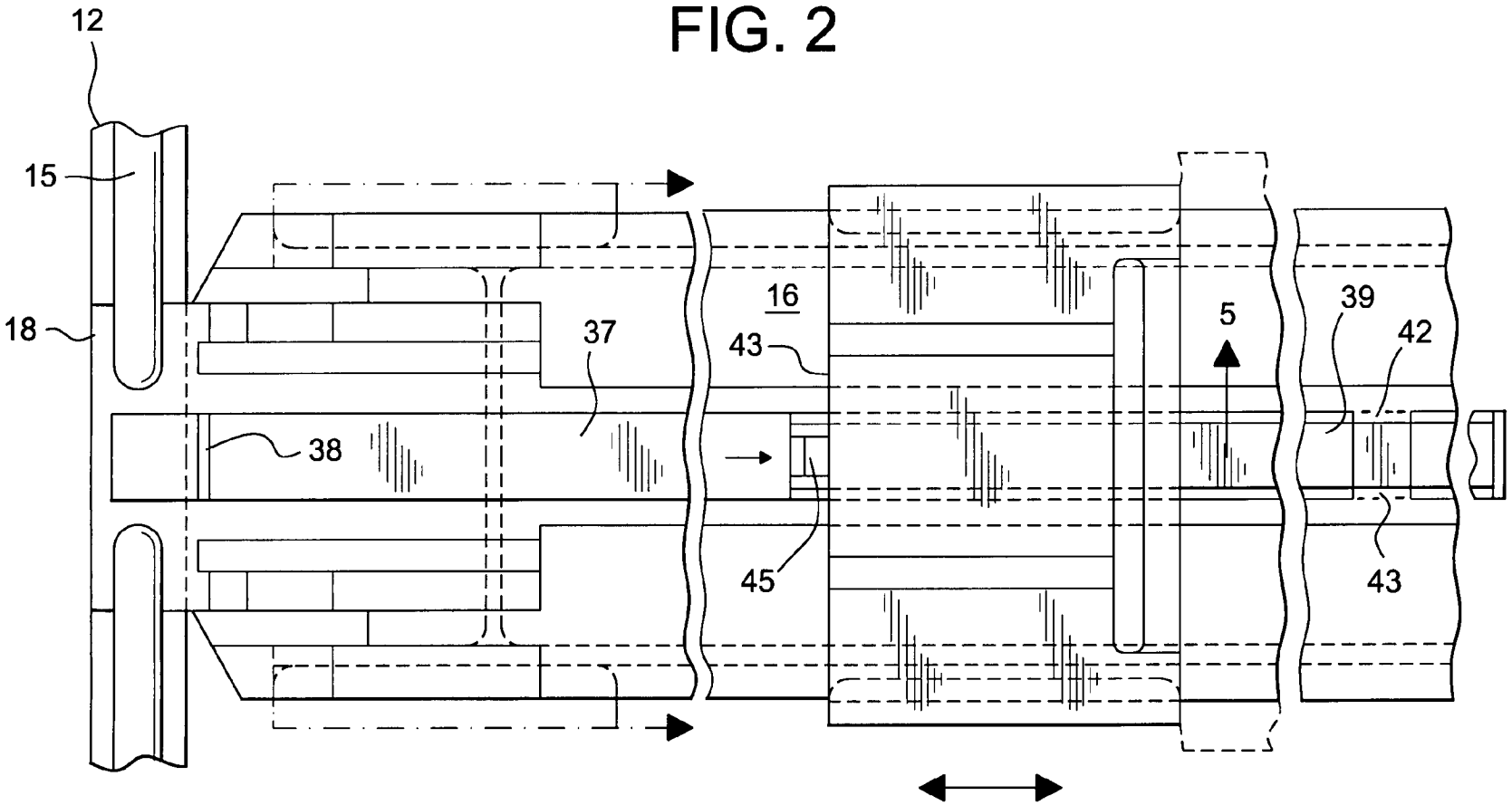
FIG. 2 is an enlarged, fragmentary top plan view of the device of FIG. 1, showing details of construction of the rear portion thereof.

Referring now to the drawing, the reference numeral 10 designates generally a display shelf such as forming part of a typical gondola structure used in many merchandising outlets for the display of merchandise. In the arrangement illustrated in FIG. 1, guide rails 11, 12 are mounted at the front and back edge areas respectively of the shelf 10. The guide rails are of a conventional type, in this case provided with a pressure sensitive adhesive along their bottom surfaces 13 for securement to the upper surface of the shelf 10. The guide rails 11, 12 have upper portions 14, 15 formed with somewhat of a T-shaped cross section (FIG. 5).

Figure 5:
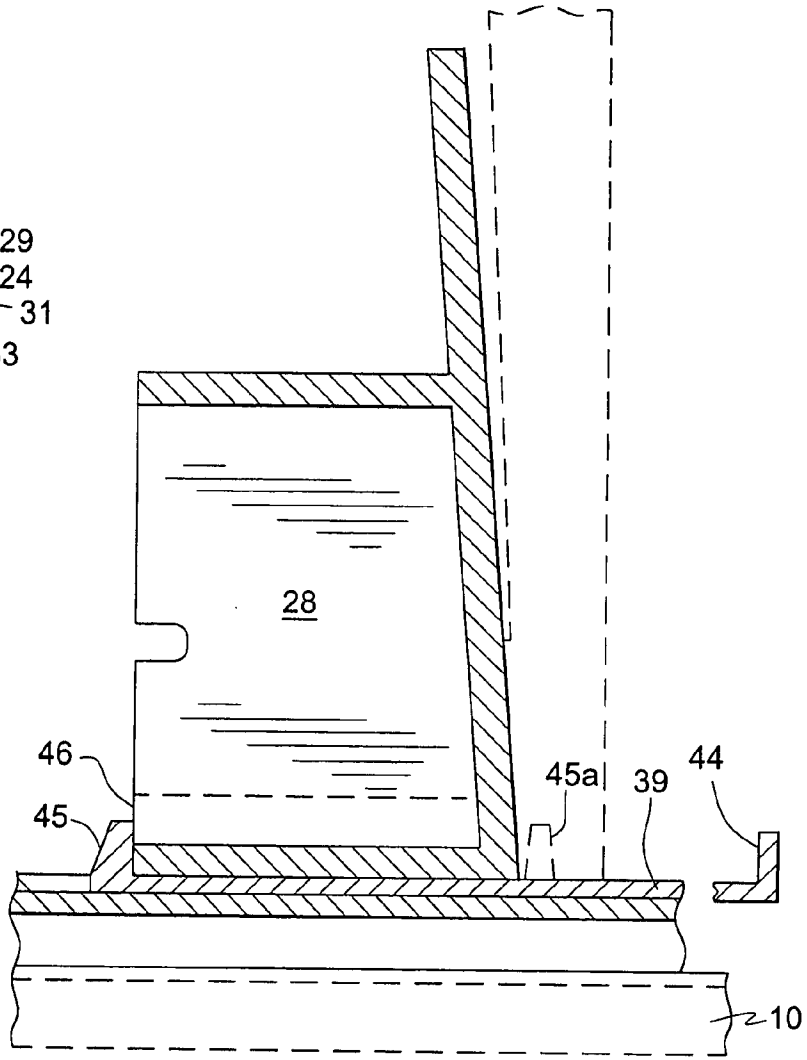
FIG. 5 is an enlarged, fragmentary cross sectional view as taken generally on line 5—5 of FIG. 2.

A display device according to the invention includes a base member 16 having elements 17, 18 at its front and back ends respectively adapted for snap-on attachment to the guide rails 11, 12, generally in the manner reflected in FIG. 5. The base member 16 is thus firmly attached to the shelf 10, but can be adjusted laterally along the rails 11, 12 to enable side-to-side positioning on the shelf display.

Figure 4:
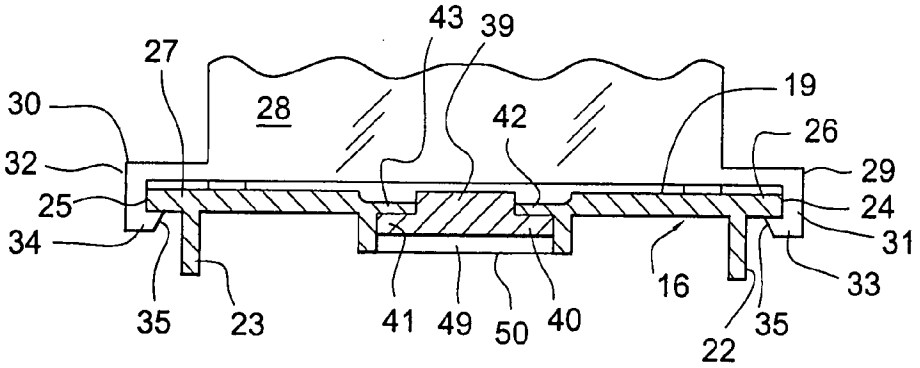
FIG. 4 is an enlarged, fragmentary cross sectional view as taken generally on line 4—4 of FIG. 1.

In the illustrated form of the invention, the base member 16 preferably is injection molding of a plastic material, such as polycarbonate, and is formed with a generally flat upper surface 19 (FIG. 4). Packages 20 of merchandise can be supported directly on the surface 19 of the base member or, where the packages are of substantial width, by separate lateral supports (not shown) spaced laterally outward from the side edges of the base member 16. Typically, shelf dividers (not shown) can be provided on opposite sides of the base member 16, in order to provide lateral confinement for the merchandise packages 20. In the event such dividers are provided, typically they will be attached to the guide rails 11, 12, accommodating lateral adjustability as needed to fit to the product items 20 being displayed. By way of example and not of limitation, divider panels of the type shown in my U.S. Design Application Ser. No. 29/185,224, filed Jun. 24, 2003 may be utilized to advantage.

The base member 16 is formed with longitudinal supports 22, 23 which extend downwardly from the support panel 19, spaced inwardly somewhat from the side edge extremities 24, 25 of that panel, to define edge flanges 26, 27. The edge extremities 24, 25 are parallel and extend generally along the full length of the base member 16, to form guide edges for a pusher sled 28. The pusher sled 28, also preferably injection molded of a suitable structural plastic material, is formed with opposite side guide flanges 29, 30, which include vertically extending side flanges 31, 32 and inwardly extending locking flanges 33, 34.

In a preferred embodiment of the invention, the locking flanges 33, 34 are formed with edges 35 which are inclined inwardly and upwardly, as shown particularly in FIG. 4. The arrangement is such that assembly of the pusher sled 28 to the base member 16 can be accomplished by engaging one of the flanges 29, 30 over a respective guide flange 26, 27 of the base member, and then pressing downward on the opposite side of the pusher sled. The slanted edge 35 functions as a cam to spread outwardly the side flange 29 or 30, enabling it to be snapped over the respective guide flange 26 or 27. Thus, the pusher sled 28 can be easily assembled to the base by a vertically downward, snap-in assembly procedure, but then cannot be detached from the base member without the use of tools or other special means. In this respect, as will be more fully described, means are provided for limiting sliding movement of the pusher sled longitudinally along the base member to predetermined front and back limit positions, such that it is not possible to slide the pusher sled off of the base member at either end of the latter.

To particular advantage, the fit between the side flange portions 31, 32 of the pusher sled, and the edge flanges 26, 27 of the base member 16 is a slight interference fit, such that the pusher sled has a "snug" sliding fit on the base member. As a result, the pusher sled 28 will tend to remain in whatever position it is moved to on the base member, until intentionally moved to a new position.

In the preferred and illustrated form of the invention, the base member 16 is shaped to define a recess 37 extending longitudinally from one end of the base member to the other. The recess 37 is open at the front end of the base member, preferably is closed at the back end, by means such as a vertical abutment stop 38. An elongated pull strip 39 is slideably received in the recess 37 for easy sliding longitudinal movement therein. The pull strip 39 preferably is relatively thin, for example around 0.085 inch, and is formed of a strong flexible material such as nylon. Preferably, the pull strip is formed with laterally extending side flanges 40, 41 (FIG. 4) which give the strip substantially the same overall width as the channel 37 in which it is received for easily sliding movement.

Advantageously, the base member is formed with a pair of confinement tabs 42, 43 which extend inward from opposite sides of the pull strip recess 37, at a position close to the front end of the base member. The confinement tabs 42, 43 overlie the side flanges 40, 41 of the pull strip and restrain it against vertical movement out of the guide recess. In the preferred form of the invention, the confinement tabs 42, 43 are provided preferably in a single location and extend for a relatively short distance, for example 0.20 inch in the longitudinal direction.

At its front extremity, the pull strip 39 is provided with a vertical tab 44 to facilitate manual engagement from in front of the display. At its back extremity, the pull strip is provided with an upwardly extending abutment element 45 positioned to engage a rearwardly facing surface 46 of the pusher sled, when the latter is mounted on the base member 16.

In a preferred embodiment of the invention, the pull strip 39 is assembled with the base member 16 by being slid in from the forwardmost end of the guide recess 37, sliding the side flanges 40, 41 thereof underneath the confinement tabs 42, 43. Once the leading (in this case back) end of the pull strip is engaged underneath the confinement tabs, the pull strip can be slid to a fully inserted, or "retracted" position in the base member, i.e., when the abutment element 45 at the back of the pull strip engages the abutment stop 38 near the back of the base member. The length of the pull strip is such that, when the fully retracted position is reached, a short front end portion 48 of the pull tab is exposed, providing access to the vertical tab 44 while at the same time keeping the pull strip in an out of the way position.

Pursuant to the invention, the pull strip 39 is assembled with the base 16 prior to mounting of the pusher sled 28 onto the base member. The last step of the assembly is performed by a vertically downward snap-over assembly operation. When the pusher sled is thus assembled, it overlies the pull strip 39 and functions, in addition to the confinement tabs 42, 43, to provide vertical confinement of the pull strip.

Figure 3:
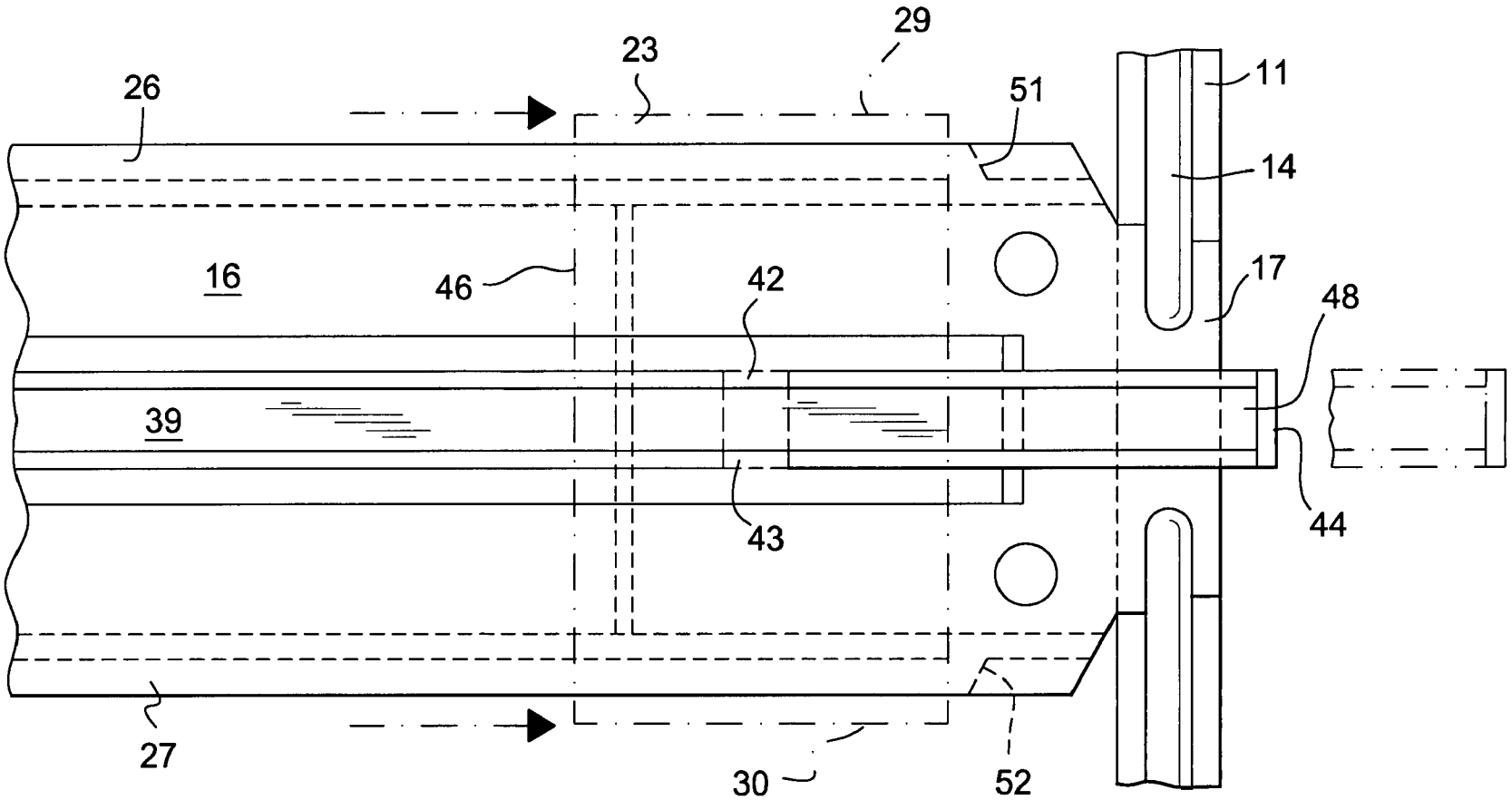
FIG. 3 is an enlarged, fragmentary top plan view of the device of FIG. 1, showing details of construction of the front portion thereof.

As can be appreciated, in order to form the confinement tabs 42, 43 in a molding process, an opening 49 must be formed in the bottom surface 50 of the pull strip recess 37, to accommodate the necessary mold parts. Having only a single pair of confinement tabs simplifies the molding process and maximizes the strength of the base member. Stops 51, 52 (FIG. 3) located adjacent the forward ends of the respective guide flanges 26, 27, engage the forwardly facing surfaces of the sled flanges 29, 30 to function as a forward limit stop for the pusher sled. Thus, the forward limit position of the pull strip 39 is a function of the forward limit position of the sled 28, since the abutment tab 45 at the back of the pull strip engages with a rearwardly facing surface 46 of the pusher sled. As will be evident in FIG. 3, when the sled (shown in broken lines in FIG. 3) is in its forwardmost limit position, the confinement tabs 42, 43 lie forward of the back edge 46 of the pusher sled and thus at all times retain confining engagement with the pull strip.

In preferred embodiments of the invention, the front and back extremities 17, 18 of the base member are formed with laterally extending socket portions opening downwardly, for a snap-in reception over the guide rails 14, 15. However, any of a variety of means may be used for mounting of the base members, including suspension between front and back guide rails, for example. The particular manner of mounting and utilization of the assembly is not a significant feature of the invention.

For certain types of package displays, where the contents of the packages are date sensitive, it is always desired that, during restocking of the shelves, newly added packages be placed at the back of the display, so that the older packages are at the front and likely to be selected by a purchaser. In such cases, it is acceptable, and may be preferable, to return the sled to a retracted position after each actuation of the pull strip in order to provide open space behind the packages just moved to an upfront position. This can be accomplished in the disclosed system by providing a second abutment tab 45*a* (FIG. 5) spaced forwardly of the tab 45 such that the two tabs 45, 45*a* can straddle the pusher sled 28. When the second abutment tab 45*a* is employed, the pusher sled 28 is assembled to the base member by being snapped over the base member at a position between the tabs 45, 45*a*, such that it is locked together for movement with the pull strip 39.

In the alternative embodiment, after the pull strip 39 is drawn forwardly to advance the merchandise to an up-front position, the pusher sled 28 is returned to a fully retracted position along with the pull strip 39. For this embodiment of the invention, the pusher sled 28 may be designed for easy sliding movement on the base member 16, as there is no need to retain the pusher member frictionally in a position behind the merchandise.

Figure 6:
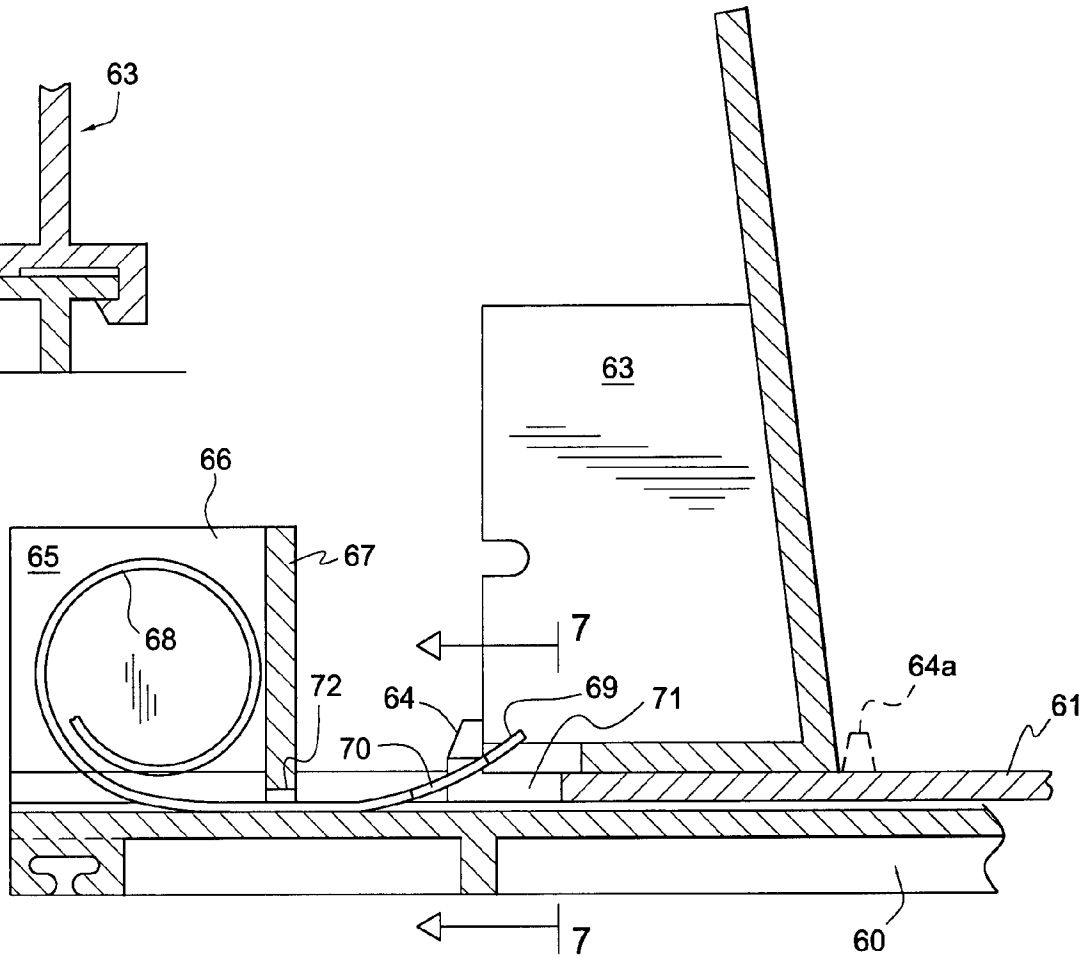
FIG. 6 is an enlarged, fragmentary cross sectional view, similar to FIG. 5, illustrating a second embodiment of the invention employing a spring element to return the pull strip.
Figure 7:
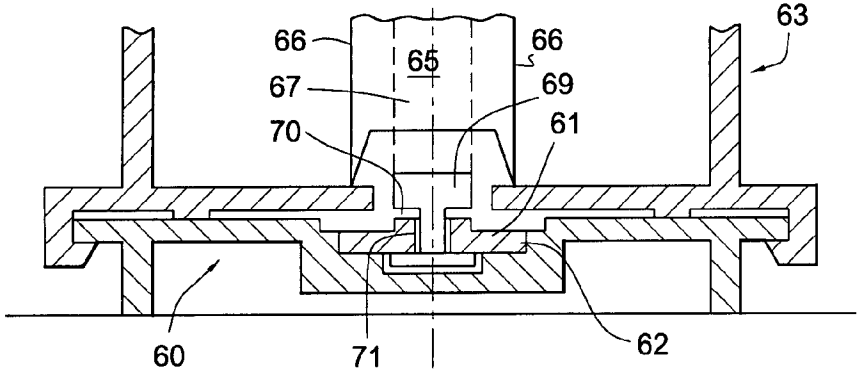
FIG. 7 is an enlarged, fragmentary cross sectional view as taken generally on line 7—7 of FIG. 6.

In an alternative embodiment of the invention, shown in FIGS. 6 and 7 of the drawing, a return spring arrangement is provided for automatically returning the pull strip member to a fully retracted position after use. In the embodiment of FIGS. 6 and 7, a base member 60 is constructed substantially in the same manner as the base member 16, for slideable reception of a pull strip member 61 in a central, longitudinally extending recess 62. A pusher sled 63 is slideably engaged with the base member 60 and, as illustrated in FIG. 6, is arranged to be engaged by an upwardly extending tab 64 at the back end of the pull strip member 61.

At the back extremity of the base member 60 a confinement housing 65 is provided, consisting of opposed side walls 66 and a front wall 67. The housing 65 receives a self-coiling strip spring 68 of a well known type used in self-actuating displays. The leading end 69 of the strip spring is notched at 70 and is arranged, when twisted, to pass through a narrow slot 71 at the back end of the pull strip 61. The end of the spring is thus attached to the pull strip in the manner indicated in FIG. 7.

A slot 72 is provided in the front wall 67 of the containment housing 65, through which the strip spring 68 is passed.

As will be understood, when the pull strip 61 is drawn forwardly, to advance the pusher sled 63, the leading end 69 of the spring is pulled along with it, causing the spring to uncoil within its containment housing 65. When the pusher member 61 is later released, the spring 68 recoils itself within the housing, causing the pull strip member 61 to be drawn rearwardly to a fully retracted position. The engagement between the pusher sled 63 and the pull strip member 61 may be such that the pusher sled remains in its advanced position. However, if a second tab 64*a* is positioned at the front of the sled, as may be desired in some circumstances, the sled 63 will return to a retracted position along with the pull strip 61.

The return spring 68 is desired in some installations, in order to assure that a pull strip member 61 can never be left in a projected position by a careless store clerk, for example.

Significant production and cost advantages are realized by providing, in the three part assembly comprising base member, pusher sled, and pull strip, of an arrangement enabling a snap-in assembly of the pusher sled, after assembly of the first two elements. In the illustrated and preferred embodiment, this is realized by first assembling the pull strip together with the base member, and then joining the pusher sled by a vertically downward snap-together assembly in which the side flanges 29, 30 of the pusher sled are snapped over the outer edges 24, 25 of the base member. The geometry of the parts is such that the pull strip is at all times engaged by the limited-area confinement tabs, but is freely slidable longitudinally with respect to the base member, with no need for an operator to have to assure proper alignment of the pull strip with additional confinement tabs located toward the rear of the base member. This is of particular significance when the pull strip is not fixed to the pusher sled and remains in an advanced position when the pull strip is retracted following a pull-out operation.

In the principal embodiment of the invention, the pull strip member is designed for a one-way engagement with the pusher sled, whereby the pusher sled is drawn forwardly by pulling on the pull strip element, but is not returned by retraction of the pull strip. In some instances, however, where the displayed merchandise may be time sensitive, it may be preferred to provide for the sled to be returned to a retracted position when the pull strip is retracted. This is easily accomplished by providing a second abutment tab on the pull strip member, spaced forwardly of the first, and cooperating with a forwardly facing surface of the pusher sled. The arrangement is such, of course, that the pusher sled can still be assembled with the base member by a vertically downward, snap-on assembly motion, by positioning the pusher sled between the spaced apart abutment tabs.

In its simplest form, the product display system of the invention relies upon the store clerk to return the pull strip member to a retracted position after pulling it forward to bring merchandise up to a forward position. However, to avoid any possibility of a careless store clerk not returning a pull strip member to its fully retracted position, with the attendant possibility of injury to a passerby and/or damage to the pull strip member, the system of the present invention provides for the optional use of a return spring, which is positioned in a fixed containment housing at the back of the base member, and is connected to the pull strip member so as always to fully retract the pull strip member when it is released by a store clerk.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A pull strip actuated pusher assembly for up-front merchandise display, which comprises, (a) an elongated base member having front and back ends and formed with parallel opposite side edge portions and longitudinally extending support surfaces, (b) a pusher sled slideably supported and guided on said base member for engaging displayed merchandise and for supporting and positioning merchandise at a front of a display, (c) a pull strip member supported on said base member and guided thereon for longitudinal sliding movement relative to said pusher sled, (d) said base member having confining elements cooperating with limited portions of said pull strip member adjacent the front end of said base member to confine said pull strip member vertically with respect to said base member, (e) said pull strip member having an element adjacent a back end portion thereof for engagement with a rearwardly facing surface of said pusher sled whereby said pusher sled can be advanced in a forward direction by said pull strip member, (f) motion limiting means for restricting maximum forward and rearward movements of said pusher sled on said base member, (g) said pusher sled having opposite side flanges for locking engagement with opposite side edge portions of said base member, (h) said pusher sled having a snap-together assembly with said base member after engagement of said pull strip member with said confining elements, (i) portions of said pull strip member spaced rearwardly of said confining elements being vertically confined by said pusher sled, and (j) said pusher sled frictionally gripping said base member such that said pusher sled tends to remain fixed in a position to which it is drawn by actuation of said pull strip member when said pull strip member subsequently is moved in a rearward direction.

2. A pull strip actuated pusher assembly according to claim 1, wherein (a) said confining elements comprise a pair of opposed confinement tabs integral with said base member and overlying opposite side edge margins of said pull strip member, (b) said pull strip member having a forward limit position determined by engagement with said pusher sled when said pusher sled is in a position of maximum forward movement on said base member, (c) said confinement tabs being positioned to overlie a portion of said pull strip when said pull strip member is in said forward limit position, and (d) said pusher sled providing vertical confinement of said pull strip member over portions thereof lying between said base member and said pusher sled.

3. A pull strip actuated pusher assembly according to claim 1, wherein (a) the side flanges of said pusher sled and the side edge portions of said base member have cooperating inclined surfaces accommodating vertically downward snap-together assembly of said pusher sled onto said base member at a position between said motion limiting means.

4. A pull strip actuated pusher assembly for up-front merchandise display, which comprises, (a) a molded plastic base member for mounting on a product display site, (b) said base member being elongated in a front to back direction and having spaced apart, parallel side edges, (c) a pull strip member slidably supported on said base member and engageable at the front of said base member, (d) said base member having confinement means adjacent a front end thereof for vertical confinement of said pull strip member, said pull strip member being free of vertical confinement by said base member over the extent thereof rearward of said confinement means, (e) a pusher sled slidably mounted on said base member for frictionally restrained forward and rearward movement thereon, (f) said pull strip member having an element engageable with said pusher sled to move said pusher sled forwardly when said pull strip member is pulled forwardly while accommodating movement of said pull strip member in a rearward direction without corresponding rearward movement of said pusher sled, (g) said pusher sled overlying said pull strip member and providing vertical confinement thereof in regions of said pull strip member underlying said pusher sled, and (h) said pusher sled being adapted for vertically downward snap-on assembly with said base member when said pull strip member is supported thereon.

5. A pull strip actuated pusher assembly according to claim 4, wherein (a) said pull strip member has an abutment element adjacent a back end thereof engageable with a rearwardly facing surface of said pusher sled for moving said sled in a forward direction, (b) an abutment stop is positioned to limit forward movement of said pusher sled on said base member, and (c) abutment means are positioned to limit rearward movement of said pull strip member on said base member.

6. A pull strip actuated pusher assembly according to claim 5, wherein (a) said pusher sled has side flanges slidably engageable with opposite side edges of said base member, and (b) at least one of said side flanges or said side edges is formed with angled surfaces enabling vertically downward, snap-on assembly of said pusher sled to said base member.

7. A pull strip member actuated pusher assembly according to claim 5, wherein (a) said abutment means limiting rearward movement of said pull strip is positioned such that at least a portion of said pull strip adjacent the front of said base member is accessible for manual engagement.

8. A pull strip actuated pusher assembly for up-front merchandise display, which comprises, (a) an elongated base member having front and back ends and formed with parallel opposite side edge portions and longitudinally extending support surfaces, (b) a pusher sled slideably supported and guided on said base member for engaging displayed merchandise and for supporting and positioning merchandise at a front of a display, (c) a pull strip member supported on said base member and guided thereon for longitudinal sliding movement, (d) said base member having confining elements cooperating with limited portions of said pull strip member adjacent the front end of said base member to confine said pull strip member vertically with respect to said base member, (e) said pull strip member having a first element adjacent a back end portion thereof for engagement with a rearwardly facing surface of said pusher sled whereby said pusher sled can be advanced forwardly by said pull strip member, (f) said pull strip member having a second element spaced forwardly of said first upwardly extending element for engagement with a forwardly facing surface of said pusher sled whereby said pusher sled can be moved rearwardly by said pull strip member, (g) motion limiting means for restricting maximum forward and rearward movements of said pusher sled on said base member, (h) said pusher sled having opposite side flanges for locking engagement with opposite side edge portions of said base member, (i) said pusher sled having a snap-together assembly with said base member, with portions of said pusher sled positioned between said first and second elements, after engagement of said pull strip member with said confining elements, and (j) portions of said pull strip member spaced rearwardly of said confining elements being vertically confined by said pusher sled.

9. A pull strip actuated pusher assembly according to claim 8, wherein (a) at least one of (i) the opposite side flanges of said pusher sled and (ii) the opposite side edge portions of said base member being angled to facilitate vertically downward snap-on assembly of said pusher sled onto said base member.

10. A pull strip actuated pusher assembly for up-front merchandise display, which comprises, (a) an elongated base member having front and back ends and formed with parallel opposite side edge portions and longitudinally extending support surfaces, (b) a pusher sled slideably supported and guided on said base member for engaging displayed merchandise and for positioning merchandise at a front of a display, (c) a pull strip member supported on said base member and guided thereon for longitudinal sliding movement separate from said pusher sled, (d) said pull strip member having an element engageable with said pusher sled whereby said pusher sled can be advanced forwardly by said pull strip while allowing said pull strip member to move rearwardly separately from said pusher sled, and (e) a return spring connected to said pull strip member and to said base member, whereby when said pull strip member is released from an extended position said return spring tends to return said pull strip member to a retracted position.

11. A pull strip actuated pusher assembly according to claim 10, wherein (a) said return spring comprises a self-coiling steel strip, (b) said base member is provided adjacent a back end portion thereof with a confinement housing for said return spring, and (c) a free outer end of said return spring is attached to said pull strip member.

12. A pull strip actuated pusher assembly according to claim 10, wherein (a) said pusher sled has opposite side flanges for locking engagement with opposite side edge portions of said base member, and (b) said pusher sled has a snap-together assembly with said base member, between said first and second upwardly extending elements, after engagement of said pull strip member with said confining elements.

* * * * *